US008523745B1

(12) United States Patent
Ihli et al.

(10) Patent No.: US 8,523,745 B1
(45) Date of Patent: Sep. 3, 2013

(54) EXERCISE METHODS AND APPARATUS

(76) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 430 days.

(21) Appl. No.: 12/927,254

(22) Filed: Nov. 10, 2010

Related U.S. Application Data

(60) Provisional application No. 61/281,018, filed on Nov. 12, 2009.

(51) Int. Cl.
*A63B 26/00* (2006.01)
*A63B 21/012* (2006.01)

(52) U.S. Cl.
USPC ..... 482/140; 482/114; 482/139

(58) Field of Classification Search
USPC ..... 482/114–119, 140, 148, 139, 126
See application file for complete search history.

(56) References Cited

U.S. PATENT DOCUMENTS 766,743 A 8/1904 Terry
913,799 A 3/1909 Burguet
1,390,095 A * 9/1921 Dettinger et al. ..... 607/78
1,573,362 A * 2/1926 Stovall ..... 482/148
1,703,375 A * 2/1929 Volk ..... 473/216
1,954,762 A * 4/1934 Wolff ..... 482/127
2,951,702 A * 9/1960 Goodwin ..... 482/127
2,959,414 A * 11/1960 Saltz ..... 482/127
3,841,627 A * 10/1974 Vetter ..... 482/110
3,885,789 A * 5/1975 Deluty et al. ..... 482/120
4,174,832 A * 11/1979 Thompson ..... 482/120
4,328,965 A * 5/1982 Hatfield ..... 482/122
4,625,962 A * 12/1986 Street ..... 482/116
4,779,866 A * 10/1988 Marshall et al. ..... 482/116
4,948,119 A * 8/1990 Robertson, Jr. ..... 482/56
4,961,573 A * 10/1990 Wehrell ..... 482/74
5,226,867 A * 7/1993 Beal ..... 482/127
5,234,395 A * 8/1993 Miller et al. ..... 482/118
5,324,243 A * 6/1994 Wilkinson ..... 482/92
5,358,461 A * 10/1994 Bailey, Jr. ..... 482/2
5,437,591 A * 8/1995 Chen ..... 482/127
5,486,149 A * 1/1996 Smith et al. ..... 482/120
5,509,873 A * 4/1996 Corn ..... 482/74
5,545,114 A * 8/1996 Gvoich ..... 482/140
5,618,249 A * 4/1997 Marshall ..... 482/127
5,665,041 A * 9/1997 Hsieh ..... 482/140
5,709,637 A * 1/1998 Gow et al. ..... 482/129
5,733,231 A * 3/1998 Corn et al. ..... 482/120
5,755,646 A * 5/1998 Chu ..... 482/118
5,792,034 A * 8/1998 Kozlovsky ..... 482/124
D399,272 S * 10/1998 Zwonitzer ..... D21/683
5,871,425 A * 2/1999 Gvoich ..... 482/140
5,876,310 A * 3/1999 Mackey et al. ..... 482/74
6,099,447 A * 8/2000 Ramsaroop ..... 482/127
6,149,559 A * 11/2000 Mackey ..... 482/124
6,283,899 B1 * 9/2001 Charnitski ..... 482/110
6,315,701 B1 * 11/2001 Shifferaw ..... 482/114
6,544,152 B2 * 4/2003 Rosati ..... 482/126
6,726,607 B1 * 4/2004 Ihli ..... 482/127

(Continued)

*Primary Examiner* — Stephen Crow

(57) ABSTRACT

A person lies supine on a floor surface with her knees bent and her feet resting on a foot supporting portion of an exercise assembly. The person uses her hands to grasp respective left and right handles on the exercise assembly proximate her left and right hips. The person positions her abdomen beneath a strap secured in series with at least one resistance device. The person moves her pelvis off the support surface subject to resistance from the resistance devices. Parts of the assembly may be used apart from the overall assembly to perform other sorts of exercises.

22 Claims, 9 Drawing Sheets

(56) References Cited

U.S. PATENT DOCUMENTS

| | | | | |
|---|---|---|---|---|
| 6,770,014 | B2 * | 8/2004 | Amore | 482/92 |
| 7,087,001 | B1 * | 8/2006 | Ihli | 482/115 |
| 7,250,021 | B2 * | 7/2007 | Leight | 482/116 |
| 7,322,909 | B1 * | 1/2008 | Loccarini et al. | 482/129 |
| 7,850,583 | B2 * | 12/2010 | Smith | 482/124 |
| 7,854,694 | B1 * | 12/2010 | Frunzi | 482/124 |
| 7,935,036 | B2 * | 5/2011 | Haynes | 482/124 |
| 2003/0211920 | A1 * | 11/2003 | Mandel | 482/116 |
| 2006/0040805 | A1 * | 2/2006 | Wilkinson | 482/124 |
| 2013/0059703 | A1 * | 3/2013 | Calantoni | 482/126 |

* cited by examiner

EXERCISE METHODS AND APPARATUS

CROSS-REFERENCE TO RELATED APPLICATION

Disclosed herein is subject matter that is entitled to the filing date of U.S. Provisional Application No. 61/281,018, filed Nov. 12, 2009.

FIELD OF THE INVENTION

The present invention relates to exercise methods and apparatus for exercising muscles of the human body.

BACKGROUND OF THE INVENTION

An object of the present invention is to provide improved exercise methods and apparatus.

SUMMARY OF THE INVENTION

According to one aspect of the present invention, a person lies supine on a floor surface with her knees bent and her feet resting on a foot supporting portion of an exercise assembly. The person uses her hands to grasp respective left and right handles on the exercise assembly proximate her left and right hips. The person positions her abdomen beneath a strap secured in series with at least one resistance device. The person moves her pelvis off the support surface subject to resistance from the resistance device(s).

A preferred embodiment of the present invention is an exercise assembly having a frame configured to rest on an underlying floor surface, wherein the frame includes at least one foot support sized and configured to accommodate a person's left and right feet when the person is lying supine on the floor surface with her knees bent. Left and right handles are mounted on the frame within reach of a person's left and right hands, respectively, when the person is resting her feet on the at least one foot support while lying supine on the floor surface with her knees bent. Left and right resistance devices are mounted on the frame, and a strap is configured to overlie a person's lower abdomen when the person is resting her left and right feet on the at least one foot support while lying supine on the floor surface with her knees bent. The strap has a left end connected to the left resistance device and a right end connected to the right resistance device.

Various features and advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
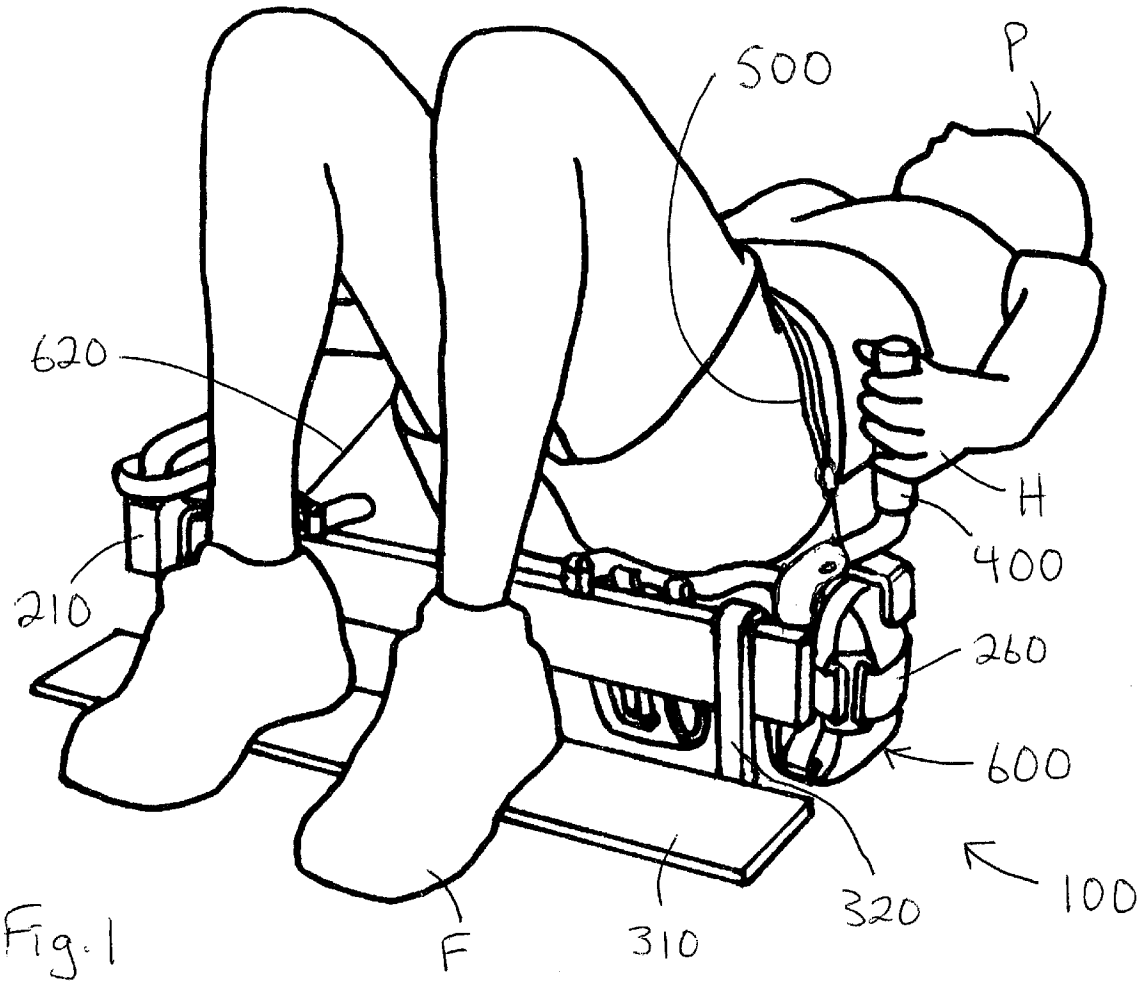
FIG. 1 is a front perspective view of a person situated relative to an exercise assembly for exercise according to the principles of the present invention.
Figure 2:
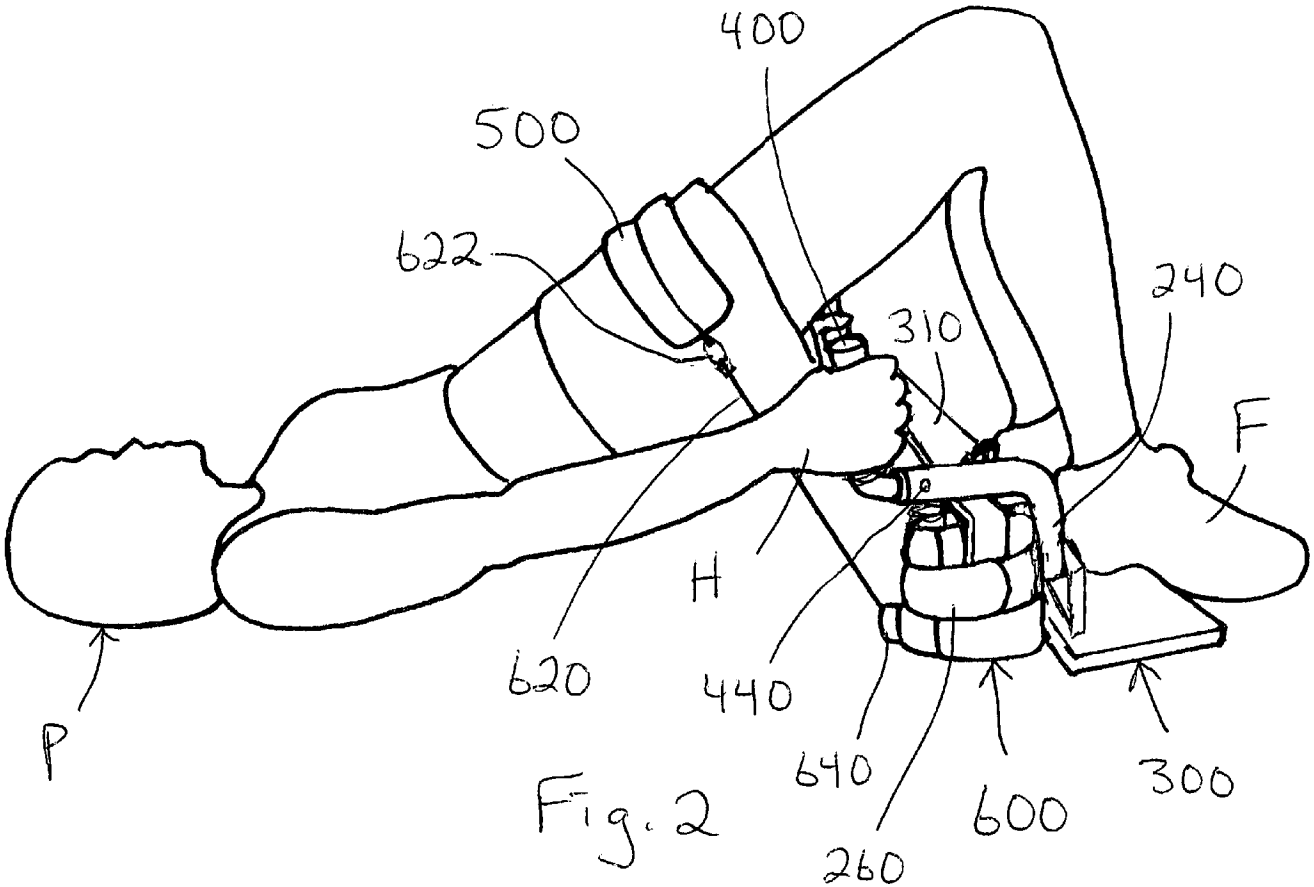
FIG. 2 is a side perspective view of the person and the exercise assembly of FIG. 1.

A preferred embodiment exercise assembly constructed according to the principles of the present invention is designated as 100 in FIGS. 1-2. The exercise assembly 100 may be described in terms of a base member 200, a foot supporting member 300 releasably connected to the base member 200, left and right handles 400 releasably connected to the base member 200, left and right resistance devices 600 releasably connected to the base member 200, and a strap 500 releasably interconnected between the resistance devices 600.

Figure 3:
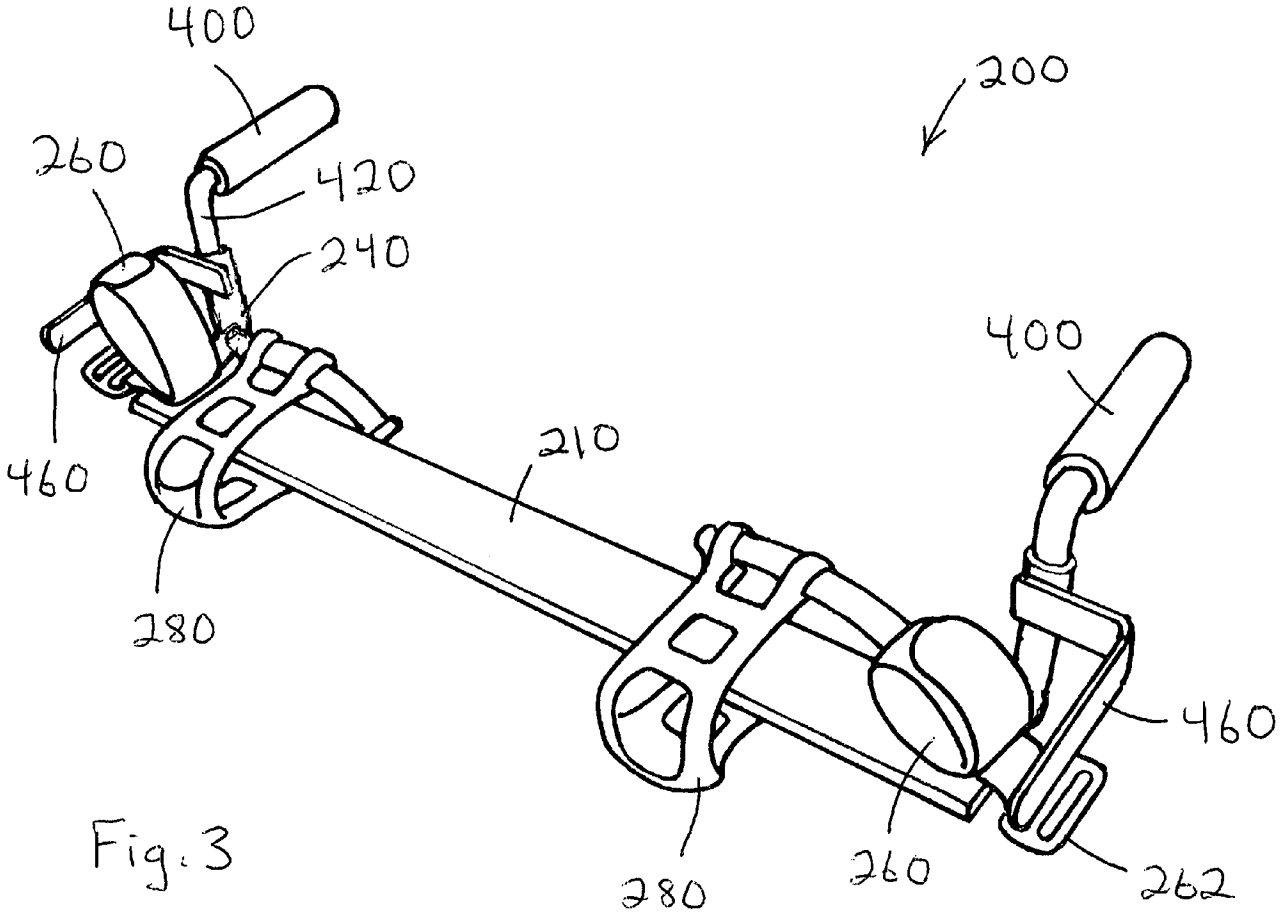
FIG. 3 is a front perspective view of a base member that is part of the exercise assembly of FIG. 1.

The base member 200 is shown by itself in FIG. 3. The base member 200 includes a flat bar 210 that is preferably stamped from a sheet of steel. Left and right handle supports 240 are secured to respective left and right ends of the bar 210. Each handle support 240 is preferably an L-shaped segment of steel tubing that is welded onto the bar 210. Each handle 400 preferably includes an L-shaped segment 420 of steel tubing having a first end that telescopes into a respective handle support 240, and an opposite, second end that is fitted with a hand grip. Left and right snap buttons 440 or other suitable fasteners occupy aligned holes in respective handles 400 and handle supports 240 to releasably and adjustably secure the former relative to the latter.

Left and right support brackets 460 are rigidly mounted on respective handle supports 240. Each support bracket 460 is preferably a flat bar that is preferably bent into an L-shaped configuration. Left and right support straps 260 are secured to respective left and right ends of the bar 210, preferably by means of rivets through respective intermediate portions thereof. Each support strap 260 includes a first end that is connected to buckle 262, and a distal second end. As shown in FIGS. 1-2, the support straps 260 cooperate with respective support brackets 460 to releasably secure respective resistance devices 600 to respective ends of the bar 210. Hook and loop fasteners on the distal end of the strap 260 and an intermediate segment of the strap 260 cooperate to snugly secure the resistance devices 600 in place.

Left and right toe cups 280 are preferably secured to respective left and right segments of the bar 210. Each toe cup 280 is preferably a conventional bicycle toe cup that is secured to the bar 210 by at least one screw. The toe cups 280 are not used during the exercise shown in FIGS. 1-2, but are useful for certain other types of exercise, as further discussed below with reference to FIG. 6, for example.

The foot supporting member 300 includes a foot platform 310 that is preferably stamped from a sheet of steel. Both the foot platform 310 and the base member bar 210 are preferably thirty inches long. Left and right J-shaped hooks 320 are secured to respective left and right end portions of the foot platform 310. A longer end segment of each hook 320 has a distal end that is preferably welded onto a back edge of the foot platform 310. A shorter end segment of each hook 320 cooperates with a respective longer segment to define a gap that is just wide enough to accommodate insertion of the base member bar 210, as shown in FIG. 1. As a result, the foot supporting member 300 is slidable onto the base member 200 to arrive at the configuration shown in FIG. 1.

Figure 5:
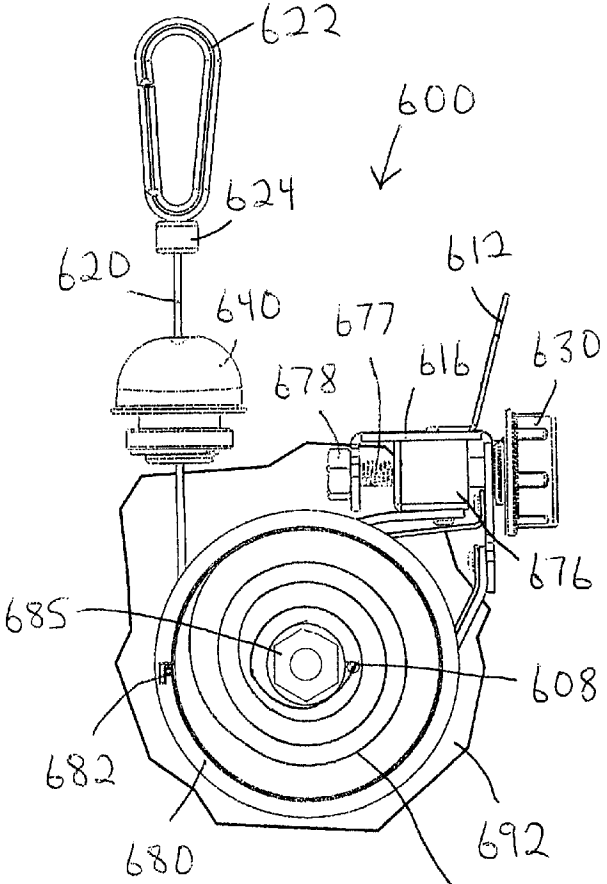
FIG. 5 is another partially sectioned front view of the resistance device of FIG. 4.
Figure 4:
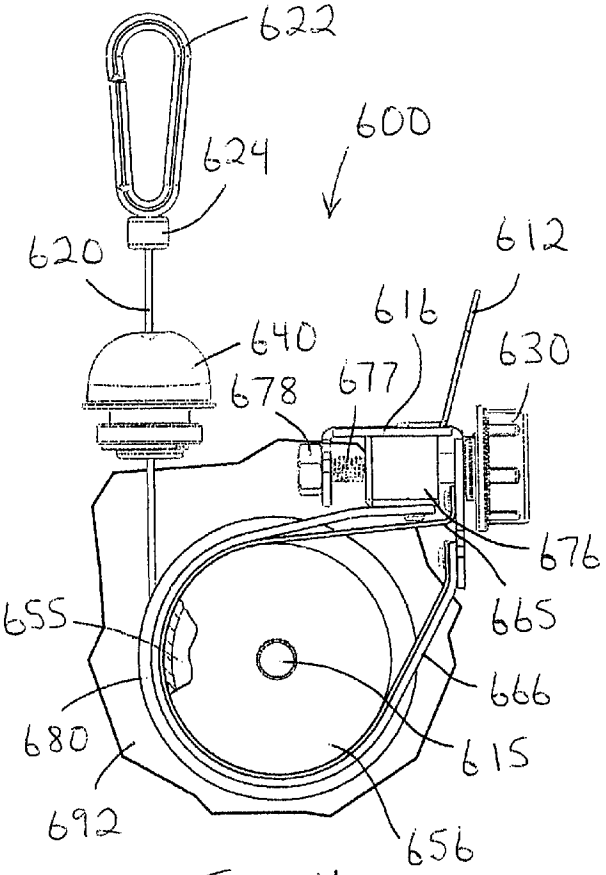
FIG. 4 is a partially sectioned front view of a resistance device that forms part of the exercise assembly of FIG. 1.

FIGS. 4-5 show components of the resistance device 600, which is similar in some respects, including certain aspects of construction, operation, and use, to the resistance devices disclosed in U.S. Pat. No. 6,726,607 to Ihli and U.S. Pat. No. 7,087,001 to Ihli, both of which are incorporated herein by reference. The resistance device 600 includes a flexible member or resistance cable 620 that is extracted from housing 692 when the extraction force exceeds an adjustable level of resistance, and that is rewound into the housing 692 when tension in the cable 620 falls below the rewind force exerted by a spring within the housing 692.

As shown in FIG. 4, the cable 620 is wound about a sheave 680, which in turn, is mounted on a rotatable shaft 615 via a conventional one-way clutch bearing 685. A hub 655 is rigidly secured to the shaft 615, and a steel cylindrical cap 656 is rigidly mounted on the hub 655 to define a resistance drum. A stainless steel brake band 666 is secured about a portion of the cap 656 with a Kevlar brake strip sandwiched therebetween. The brake band 666 cooperates with the resistance drum to provide resistance to rotation of the shaft 615 in either direction.

As shown in FIG. 5, a coiled rewind spring 690 is nested within a compartment defined by the sheave 680. An inner end of the spring 690 is anchored to the housing 692 via a peg 608, and an opposite, outer end of the spring 690 is anchored to the sheave 680 via a flange 682. As a result, the spring 690 biases the sheave 680 to rotate in a first rotational direction relative to the shaft 615 and the housing 692. The sheave 680 rotates together with the shaft 615 and relative to the housing 692 in an opposite, second rotational direction in response to extraction of the cable 620. Thereafter, when the cable 620 is released, the rewind spring 690 rotates the sheave 680 relative to the shaft 615 to retract the cable 620 within the housing 692.

A knob 630 is rotatably mounted on an end of the housing 692, and rotates relative to the housing 692 to adjust the level of resistance associated with the resistance drum. The housing 692 includes a bracket or frame member 616 that is preferably a stamped metal part. The frame member 616 is preferably secured in place between opposing "halves" of the housing 692 by means of internal structure on the housing shells, as well as fasteners that secure the halves to one another. A first rivet or other suitable fastener secures a first end of the brake strip 665 to a first portion of the frame member 616. A second rivet or other suitable fastener secures an opposite, second end of the brake strip 665 to a discrete, second portion of the frame member 616. The second rivet also preferably secures an end of the tension band 666 to the second portion of the frame member 616.

An opposite end of the tension band 666 is secured to a slide block 676 by means of a separate fastener, which is preferably a screw. The slide block 676 is threaded onto a bolt 677, and the slide block 676 bears against the frame member 616 in a manner that prevents rotation while allowing linear travel of the former relative to the latter. The bolt 677 is rotatably mounted within upper and lower openings in the frame member 616. An upper end of the bolt 677 is keyed to the knob 630, and a lower end of the bolt 677 is rigidly fastened to a nut 678. A thrust bearing is preferably disposed between the knob 630 and the frame member 616 to accommodate relative rotation therebetween. The foregoing elements cooperate to rotatably mount the bolt 677 in a specific position relative to the frame. A lower end of the frame member 616 is configured and arranged to limit downward travel of the slide block 676 along the bolt 677. On an alternative embodiment, a pin or other suitable stop is preferably secured to a lower section of the bolt 677 to function as the stopping means.

When the knob 630 is rotated in a first direction, tension in the tension band 666 increases, and when the knob 630 is rotated in an opposite, second direction, tension in the tension band 666 decreases. In either case, tension in the brake material 665 remains relatively unaffected, while compression of the brake material 665 against the cap 656 increases or decreases in direct relation to the change in tension in the tension band 666. On a working embodiment of the device 600, the resulting resistance experienced by a user is smooth and predictable through a range of resistance from 2 to 40 pounds in response to less than two full rotations of the knob 630.

A re-directional bearing assembly 640 is movably mounted on top of the housing 692, and the cable 620 is routed through the re-directional bearing assembly 640 to accommodate extraction of the cable 620 in any direction having an upward component relative to the top of the housing 692. Persons skilled in the art will recognize that the re-directional bearing 640 is located at one of six available "corner locations" on the housing 692, and furthermore, that it need not occupy an orthogonal or parallel orientation relative to the longitudinal axis of the adjustment bolt 677.

A bead or stop 624 is secured to an external portion of the cable 620, and the bead 614 is too large to fit through the opening defined by the re-directional bearing assembly 640, thereby preventing the distal end of the cable 620 from becoming lost inside the housing 692. A carabineer clip 622 is connected to an outer distal end of the cable 620 to releasably connect the cable 620 to any of various force receiving members, including the handle shown in FIG. 11 of U.S. Pat. No. 7,087,001, for example.

As shown in FIGS. 1-2, the strap 500 is interconnected between the flexible members 620 emanating from respective left and right resistance devices 600. In this regard, each carabineer 622 is connected to a respective ring on the strap 500. FIG. 1 shows the person P in a ready position, lying supine on an underlying floor surface with her knees bent and her feet F on the foot platform 310, her hands H on the handles 400, and the strap 500 extending across her lower abdomen. FIG. 2 shows the person P in an exerted position, having decreased the angle defined between her chest and upper legs by moving her hips upward against resistance provided by the resistance devices 600. As the person moves back and forth from the positions shown in FIGS. 1 and 2, she uses her hands H and her feet F to stabilize the assembly 100, thereby providing reactionary force to the tension experienced by the flexible members 620.

Figure 6:
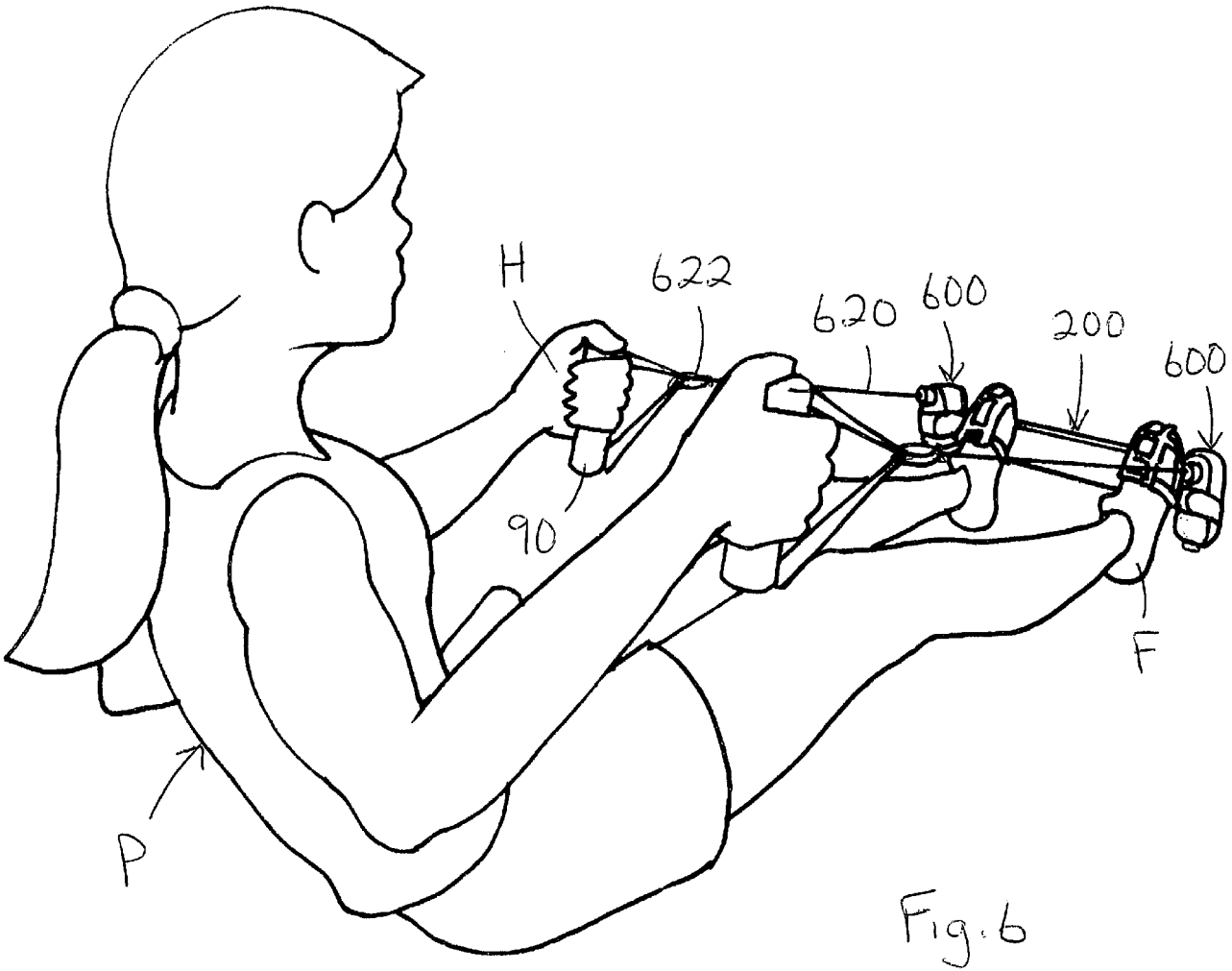
FIG. 6 is a perspective view of a person performing an alternative exercise with just the base member of FIG. 3 and two of the resistance devices of FIGS. 4-5.

FIG. 6 shows a person P exercising with an embodiment of the present invention that includes the base member 200 and the resistance devices 600, but not the strap 500. The person's left and right feet F are situated in respective toe cups 260 on the base member 200, and the person's left and right hands are grasping respective left and right handles 90, which are secured to respective resistance devices 600 via respective flexible members 620 and respective carabineers 622. As suggested by the pose shown in FIG. 6, this arrangement accommodates a row-type exercise.

Figure 7:
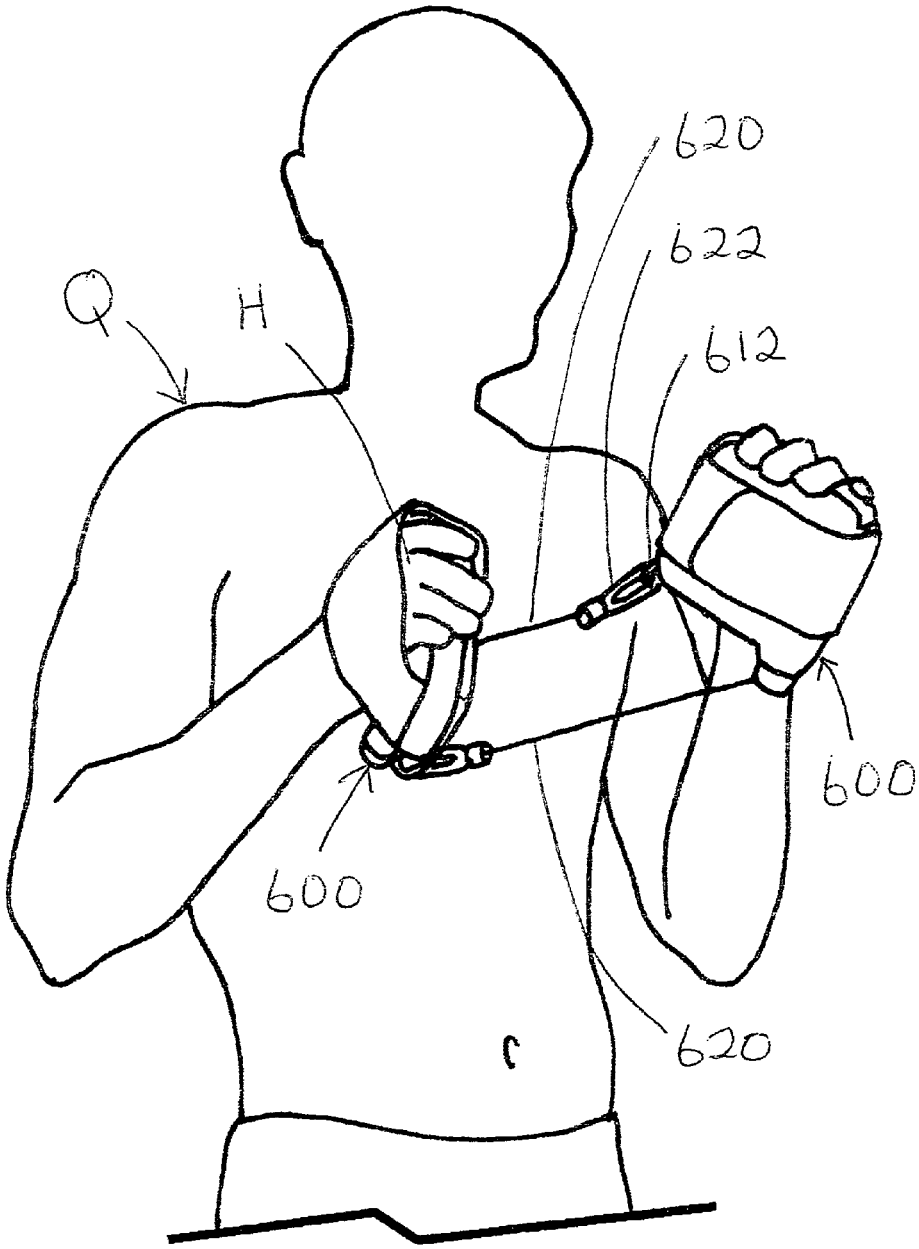
FIG. 7 is a perspective view of a person performing an alternative exercise with just two of the resistance devices of FIGS. 4-5.

As shown in FIG. 7, two resistance devices 600 may alternatively be connected to one another at respective attachment members 612. When held in respective hands H of a person Q and arranged as shown in FIG. 22, the resistance devices 600 may be used to perform various upper body exercises.

Figure 8:
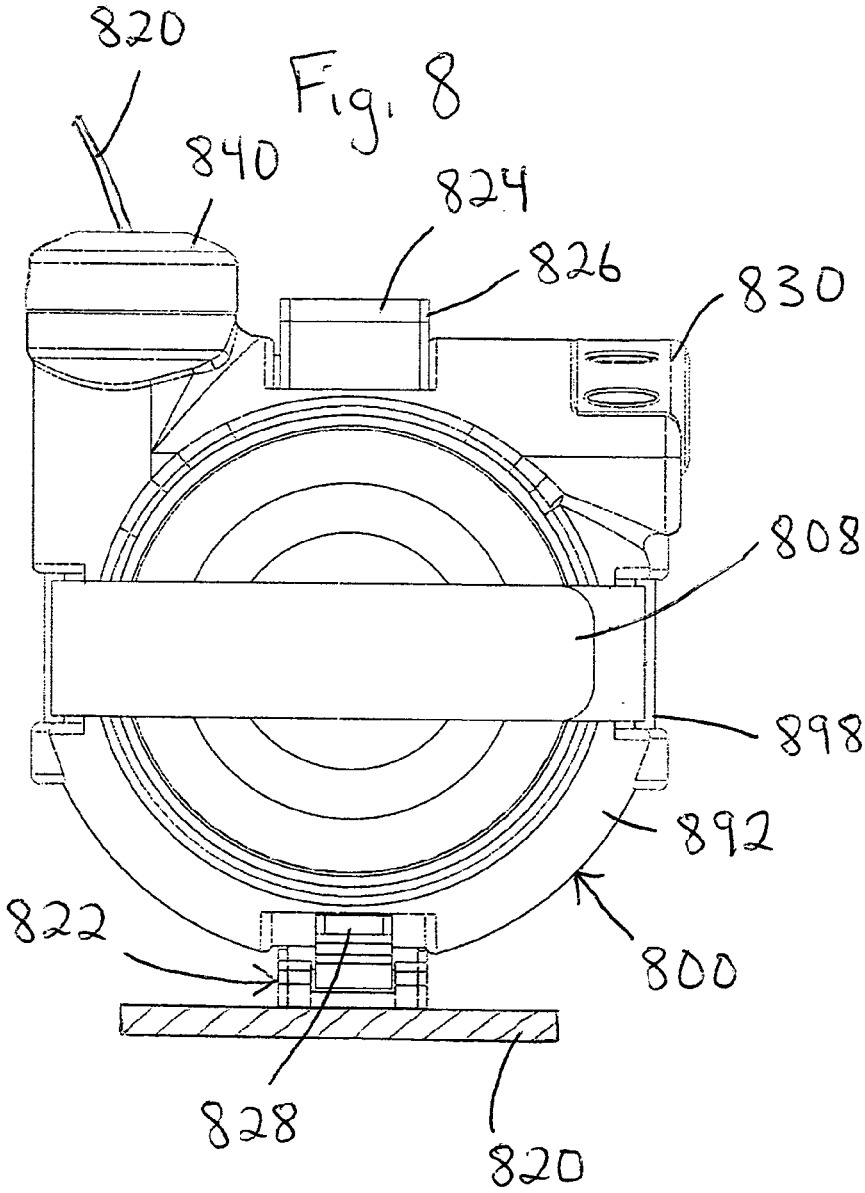
FIG. 8 is a sectioned end view of a first end of an alternative embodiment base member with an alternative embodiment resistance device mounted thereon.
Figure 9:
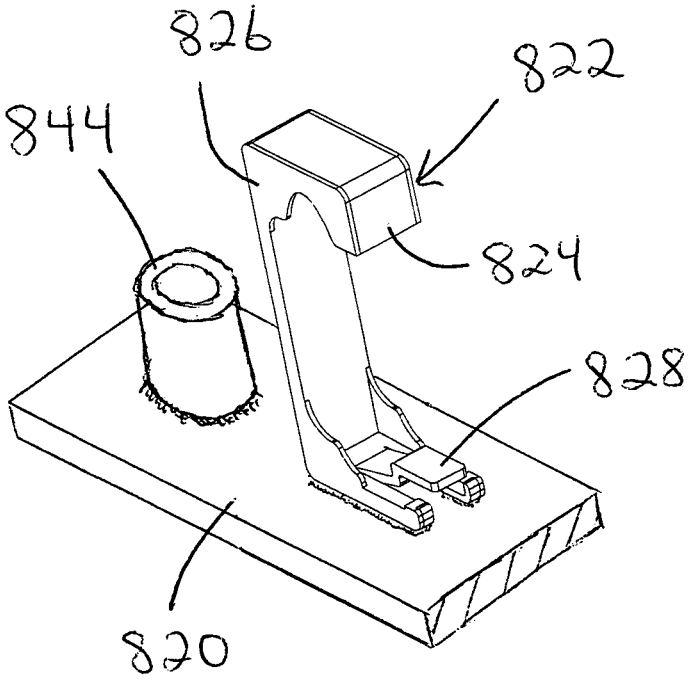
FIG. 9 is a sectioned perspective view of an opposite, second end portion of the alternative embodiment base bar of FIG. 8.

FIG. 8 shows an alternative embodiment resistance device 800 releasably mounted on an alternative embodiment base member bar 820, and FIG. 9 shows a portion of the base member bar 820 by itself. The resistance device 800 provides resistance in the same manner as the resistance device 600 described with reference to FIGS. 4-5. Among other things, the resistance device 800 includes a housing 892 that defines notches at 12:00, 3:00, 6:00, and 9:00. At least the notches at 3:00 and 9:00 are interrupted by respective steel pins 898 that cooperate with the main body of the housing 892 to define strap receiving slots. A strap 808 is selectively inserted through each slot and secured to itself via hook and loop type fasteners. The strap 808 accommodates usage of the resistance device 800 as shown in FIG. 7 with reference to the resistance devices 600.

An adjustment knob 830 is located at a corner of the housing 892, to one side of the 12:00 notch, and a re-directional bearing 840 is located at a corner of the housing 892, to an opposite side of the 12:00 notch. A flexible member or cable 820 extends from a distal end, disposed outside the housing 892, through the re-directional bearing 840, to an opposite end portion, wrapped about a sheave. A rewind spring is interconnected between the sheave and the housing 892 to encourage the flexible member 820 to wind onto the sheave. On the resistance device 800, a band brake arrangement resists removal of the flexible member 820 from the sheave. On other embodiments, different types of resistance arrangements may be used in the alternative.

FIG. 9 shows one end of the alternative embodiment base member with the understanding that an opposite end is a mirror image thereof. A handle support 844 is rigidly secured to an end of the base member bar 820. The handle support 844 is preferably a steel tube that is welded to the base member bar 820. A receptacle 822 is rigidly secured to an end of the base member bar 820, inward from the handle support 844.

The receptacle 822 preferably includes a C-shaped frame member 824 and a somewhat similarly shaped latch member 826. The frame member 824 is preferably a flat steel bar that has been formed into the desired configuration, and welded in place onto the base member bar 820. A lower end of the frame member 824 is bifurcated or pronged for reasons discussed below. The latch member 826 is preferably an injection molded plastic part that fits into the frame member 824, and that is preferably secured in place by at least one screw. The latch member 826 defines an inwardly facing periphery that matches an external periphery defined by the resistance device housing 892.

FIG. 8 shows the resistance device 800 nested inside the receptacle 822 and ready for use as shown in FIGS. 1-2 and 7, for example. The resistance device 800 is moved into this arrangement by feeding the top of the housing 892 into the top of the receptacle 822, and then sliding the bottom of the housing 892 past a latch 828 on the receptacle 822. The latch 828 is configured to snap into alignment with a complementary portion of the resistance device housing 892 as the resistance device housing 892 arrives at the position shown in FIG. 8.

The latch 828 may be described as an integrally formed leaf spring on a lower end of the latch member 826. In order to remove the resistance device housing 892 from the receptacle 822, the latch 828 must be deflected downward between the pronged ends of the frame member 824. This arrangement facilitates convenient connection of the resistance device 800 to the base member bar 820, and convenient removal of the resistance device 800 from the base member bar 820. Moreover, the housing 892 is preferably configured to accommodate reorientation of the resistance device 800 relative to the receptacle 822 when the strap 808 is removed from the housing 892.

Figure 10:
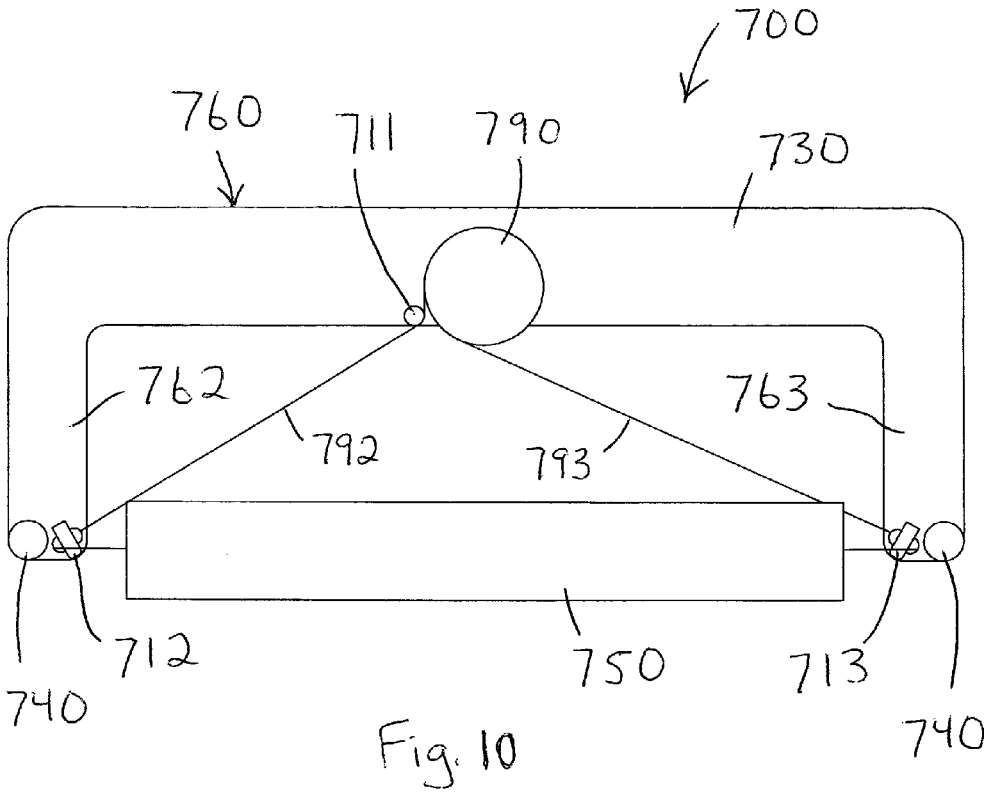
FIG. 10 is a diagrammatic top view of an alternative embodiment exercise assembly constructed according to the principles of the present invention.

FIG. 10 shows an alternative embodiment exercise assembly 700 constructed according to the principles of the present invention. The exercise assembly 700 may be described in terms of a frame 760 having an integral foot supporting member 730, left and right handles 740 mounted on the frame 760, a resistance device 790 mounted on the frame 760, and a strap 750 interconnected between first and second flexible members 792 and 793 emanating from the resistance device 790.

The frame 760 may be described as a U-shaped member that is preferably stamped from a sheet of steel. The resistance device 790 is secured in place at a central location on the U-shaped member 760. A pulley guide 711 is mounted on the frame 760, proximate one side of the resistance device 790, to re-route a flexible member 792 emanating from the resistance device 790. A second flexible member 793 emanates from the resistance device 790 proximate the pulley guide 711.

The resistance device 790 is functionally similar to the isokinetic resistance devices disclosed in U.S. Pat. No. 5,511,740 to Loubert et al., which is incorporated herein by reference. Persons skilled in the art will recognize that the resistance device shown in FIG. 4-5 may be modified, as suggested by Loubert et al., to include a second flexible member, second sheave, second one-way clutch bearing, and second rewind spring, and used in place of the resistance device 790 on the embodiment 700 to create an alternative embodiment. Moreover, two of the Loubert et al. resistance devices may be modified, as suggested by this disclosure, to eliminate a respective flexible member, a respective sheave, a respective one-way clutch bearing, and a respective rewind spring, and used in place of respective resistance devices 600 on the preferred embodiment 100 to create another alternative embodiment.

The foot supporting member 730 is defined by the base of the U-shaped member 760, which is flat and relatively wide and deep. The distal end portions 762 and 763 of the U-shaped member 760 are relatively thinner and shorter than the base, and they extend from respective ends of the base to distal ends. A left handle 740 is mounted on the distal end of the left end portion 762, and a right handle 740 is mounted on the distal end of the right end portion 763. Each handle 740 is preferably welded in place and extends vertically upward from a respective end portion 762 or 763.

A left pulley guide 712 is secured in place on the distal end of the left end portion 762, and a right pulley guide 713 is secured in place on the distal end of the right end portion 763. The flexible member 792 is routed from the resistance device 790, about the pulley guide 711, about the pulley guide 712, to a distal end that is secured to a left end of the strap 750. The flexible member 793 is routed from the resistance device 790, about the pulley guide 713, to a distal end that is secured to an opposite, right end of the strap 750.

A person uses the exercise assembly 700 in the same manner as the exercise assembly 100 described above. Contrary to the resistance devices 600, the resistance device 790 provides resistance as a function of how much force is applied to the flexible members 792 and 793. As noted above, persons skilled in the art will recognize that additional embodiments may be made by using left and right, single cable versions of the resistance device 790, or by using a dual cable version of the resistance devices 600, or by using altogether different types and/or numbers of resistance devices.

Persons skilled in the art will recognize that the subject present invention may be described in terms of methods with reference to the foregoing embodiments. For example, the present invention may be described in terms of a method of performing exercise using an exercise assembly. One such method is performed by lying supine on a floor surface with one's knees bent and one's feet resting on a foot supporting portion of the exercise assembly; using one's left and right hands to grasp respective left and right handles disposed on respective left and right sides of the exercise assembly proximate one's left and right hips; positioning one's abdomen beneath a strap secured in series with at least one resistance device; and moving one's pelvis off the support surface subject to resistance from each said resistance device.

Recognizing that this disclosure will enable persons skilled in the art to derive various alternative embodiments and applications, the scope of the subject invention should be limited only to the extent of the claims set forth below.

What is claimed is:

1. An exercise assembly for a person, comprising:

a frame configured to rest in a stable position on an underlying floor surface, wherein the frame includes a foot supporting surface sized and configured to accommodate a person's left and right feet when the person is lying supine on the floor surface with her knees bent;

a left handle and a right handle, wherein each said handle is mounted in a respective fixed position on the frame to define a respective hand-hold within reach of a person's left and right hands, respectively, when the person is resting her feet on the foot supporting surface while lying supine on the floor surface with her knees bent;

a left resistance device and a right resistance device, wherein each said resistance device is mounted on the frame; and a strap configured to overlie a person's lower abdomen when the person is resting her left and right feet on the foot supporting surface while lying supine on the floor surface with her knees bent, wherein the strap has a left end connected to the left resistance device and a right end connected to the right resistance device.

2. The exercise assembly of claim 1, wherein the left handle the left resistance device are mounted on a left end of the frame, and the right handle and the right resistance device are mounted on an opposite, right end of the frame.

3. The exercise assembly of claim 2, wherein the frame includes a base member and at least one foot support removably connected to the base member, and the at least one foot support defines the foot supporting surface.

4. The exercise assembly of claim 3, wherein the base member is configured and arranged to occupy a first orientation relative to the floor surface when arranged for use together with the at least one foot support, and the base member is configured and arranged to occupy a discrete, second orientation relative to the floor surface when arranged for use without the at least one foot support.

5. The exercise assembly of claim 1, wherein left and right toe cups are mounted on the frame to receive the person's left and right feet, respectively.

6. The exercise assembly of claim 1, wherein each said handle is selectively removable from the frame to accommodate performance of an alternative exercise.

7. The exercise assembly of claim 1, wherein each said handle overlies a respective said resistance device when the foot supporting surface is parallel to the floor surface.

8. The exercise assembly of claim 1, wherein each said handle extends vertically upward and then horizontally when the person is resting her feet on the foot supporting surface while lying supine on the floor surface with her knees bent and her hands on respective said handles.

9. The exercise assembly of claim 1, wherein the handles define an uppermost height of the exercise assembly when the exercise assembly is sitting idle and ready for use.

10. The exercise assembly of claim 1, wherein a left flexible member extends from the left end of the strap to a guide on the left resistance device, and a right flexible member extends from the right end of the strap to a guide on the right resistance device, and each said guide is disposed within six inches of the support surface when the person is resting her feet on the foot supporting surface while lying supine on the floor surface with her knees bent.

11. The exercise assembly of claim 1, wherein each said resistance device is selectively removable from the frame.

12. The exercise assembly of claim 1, wherein the foot supporting surface is a continuous platform sized and configured to support both said feet in a range of locations.

13. A method of performing exercise using an exercise assembly, comprising the steps of:

providing an exercise assembly;

lying supine on a floor surface with one's knees bent and one's feet resting on a foot supporting portion of the exercise assembly;

using one's left and right hands to grasp respective left and right handles disposed on respective left and right sides of the exercise assembly proximate one's left and right hips;

positioning one's abdomen beneath a strap secured in series with at least one resistance device; and moving one's pelvis off the support surface subject to resistance from said at least one resistance device.

14. The method of claim 13, further comprising the step of re-positioning at least one of the feet along the foot supporting portion and repeating the moving step.

15. The method of claim 13, wherein the positioning step involves connecting a left end of the strap to a flexible member emanating from a left resistance device disposed on a left side of the exercise assembly proximate one's left hip, and connecting an opposite, right end of the strap to a flexible member emanating from a right resistance device disposed on a right side of the exercise assembly proximate one's right hip.

16. The method of claim 13, comprising the alternative steps of removing each said resistance device from the exercise assembly; securing the left resistance device in one's left palm; securing the right resistance device in one's right palm; securing the left flexible member to the right resistance device; securing the right flexible member to the left resistance device; and performing an arm exercise subject to resistance from each said resistance device.

17. An exercise assembly for a person, comprising:

a frame configured to rest in a stable position on an underlying floor surface, wherein the frame includes a foot supporting surface sized and configured to accommodate a person's left and right feet when the person is lying supine on the floor surface with her knees bent;

a left handle and a right handle, wherein each said handle is mounted on the frame in a generally fixed orientation during exercise and within reach of a person's left and right hands, respectively, when the person is resting her feet on the foot supporting surface while lying supine on the floor surface with her knees bent; and a strap configured to overlie a person's lower abdomen when the person is resting her left and right feet on the foot supporting surface while lying supine on the floor surface with her knees bent, wherein the strap has a left end connected to a left resistance cord that extends from a left side of the frame and a right end connected to a right resistance cord that extends from a right side of the frame, and the strap is many times wider than each said resistance cord.

18. The exercise assembly of claim 17, wherein the left resistance cord emanates from a left resistance device releasably mounted on a left side of the frame, and the right resistance cord emanates from a right resistance device releasably mounted on a right side of the frame.

19. The exercise assembly of claim 17, wherein the foot supporting surface is part of a continuous platform sized and configured to support both said feet in a range of locations.

20. The exercise assembly of claim 17, wherein each said handle slides into a respective tube on the frame.

21. The exercise assembly of claim 17, wherein each said handle includes a first portion that is connected to the frame and a second portion that is rigidly connected to the first portion, and each said first portion extends perpendicular to a respective said second portion, and a respective hand grip is disposed on each said second portion.

22. The exercise assembly of claim 17, wherein each said handle is selectively removable from the frame to accommodate an alternative exercise.

* * * * *